US007838789B2

(12) United States Patent
Stoffers et al.

(10) Patent No.: US 7,838,789 B2
(45) Date of Patent: Nov. 23, 2010

(54) ROCKER SWITCH

(75) Inventors: Michael Stoffers, Berlin (DE); Rainer Maurer, Berlin (DE); Uwe Gillmann, Berlin (DE)

(73) Assignee: CoActive Technologies, Inc., Newton, MA (US)

( * ) Notice: Subject to any disclaimer, the term of this patent is extended or adjusted under 35 U.S.C. 154(b) by 606 days.

(21) Appl. No.: 11/895,733

(22) Filed: Aug. 27, 2007

(65) Prior Publication Data

US 2008/0053806 A1 Mar. 6, 2008

(30) Foreign Application Priority Data

Aug. 30, 2006 (DE) ..... 10 2006 041 951

(51) Int. Cl.
*H01H 19/00* (2006.01)

(52) U.S. Cl. ..... 200/553; 200/339

(58) Field of Classification Search ..... 200/553, 200/556–562, 336, 339, 4, 11 R, 11 TW
See application file for complete search history.

(56) References Cited

U.S. PATENT DOCUMENTS 5,510,583 A * 4/1996 Pescetto ..... 200/1 B
6,642,459 B2 11/2003 Chou et al.
2004/0188235 A1* 9/2004 Sugimoto et al. ..... 200/339

FOREIGN PATENT DOCUMENTS

| | | | |
|---|---|---|---|
| EP | 0112483 | A1 | 7/1984 |
| EP | 0638815 | A1 | 2/1995 |
| GB | 2375890 | A | 11/2002 |
| JP | 2003-234047 | | 8/2003 |

* cited by examiner

*Primary Examiner*—Renee S Luebke
*Assistant Examiner*—Marina Fishman
(74) *Attorney, Agent, or Firm*—Pepper Hamilton LLP

(57) ABSTRACT

A rocker switch (10) is provided with a mechanical switch unit consisting of a switch housing (11) made of plastic, a switching element (14) supported in spring-loaded manner on said switch housing so as to be capable of moving back and forth, and an actuating rocker (16) connected to the switching element (14), and also with limit-stop elements (48, 49, 51, 52) for limiting the actuating angle of the actuating rocker (16), and with an electrical switch unit. In order to obtain variable actuating angles and overcompression functions, the invention provides that the actuating rocker (16) is provided with an overcompression element (36) which in one or both of the actuating directions comes to be operationally connected to an overcompression stop (46, 47) on the switch housing (11) before the limit-stop elements (51, 52) come into operation.

19 Claims, 3 Drawing Sheets

ROCKER SWITCH

CROSS-REFERENCE TO RELATED APPLICATION

Applicant claims priority from German patent application No. 102006041951.0 filed Aug. 30, 2006.

BACKGROUND OF THE INVENTION

The present invention relates to a rocker switch. In a rocker switch of such a type that is known from DE 101 17 597 C1 the actuating angle in both directions of motion is formed exclusively by the limit-stop elements on the switch housing, on the one hand, and on the actuating rocker, on the other hand. This means that in each direction there is only a single switching function in each given case.

The object of the present invention is to configure a rocker switch of such a type with the aid of an overcompression function so as to render it capable of being employed for further switching functions.

SUMMARY OF THE INVENTION

By virtue of the measures according to the invention, an overcompression function towards the one or other side, or towards both sides, is enabled in straightforward manner in an analog rocker switch. Depending on the configuration of the overcompression stop and/or limit stop, various actuating angles between the initial position and the overcompression stop, and also between the overcompression stop and the limit stop, can be provided in a straightforward manner. These may, in addition, be variable in both directions.

In order to obtain variable actuating angles in the direction towards the overcompression point and thereafter, and in order to obtain overcompression functions in the one or other direction or in both directions or even in no direction, the features are provided individually or in combination. Hence by simple replacement, for example of the inner part of the switch housing, an appropriate variability in the actuating angles and in the locations of the overcompression functions is obtained. This variability can be produced in straightforward manner by the molding tool with which the inner part of the switch housing made of plastic is molded—for example, injection-molded—being provided with removable cores which can be employed for the purpose of producing the differing lengths of the domes for the overcompression-function stops and/or of the domes for the limit stops.

Further particulars of the invention can be gathered from the following description, in which the invention has been described and elucidated in greater detail on the basis of the exemplary embodiment represented in the drawing.

DESCRIPTION OF THE INVENTION

Figure 1:
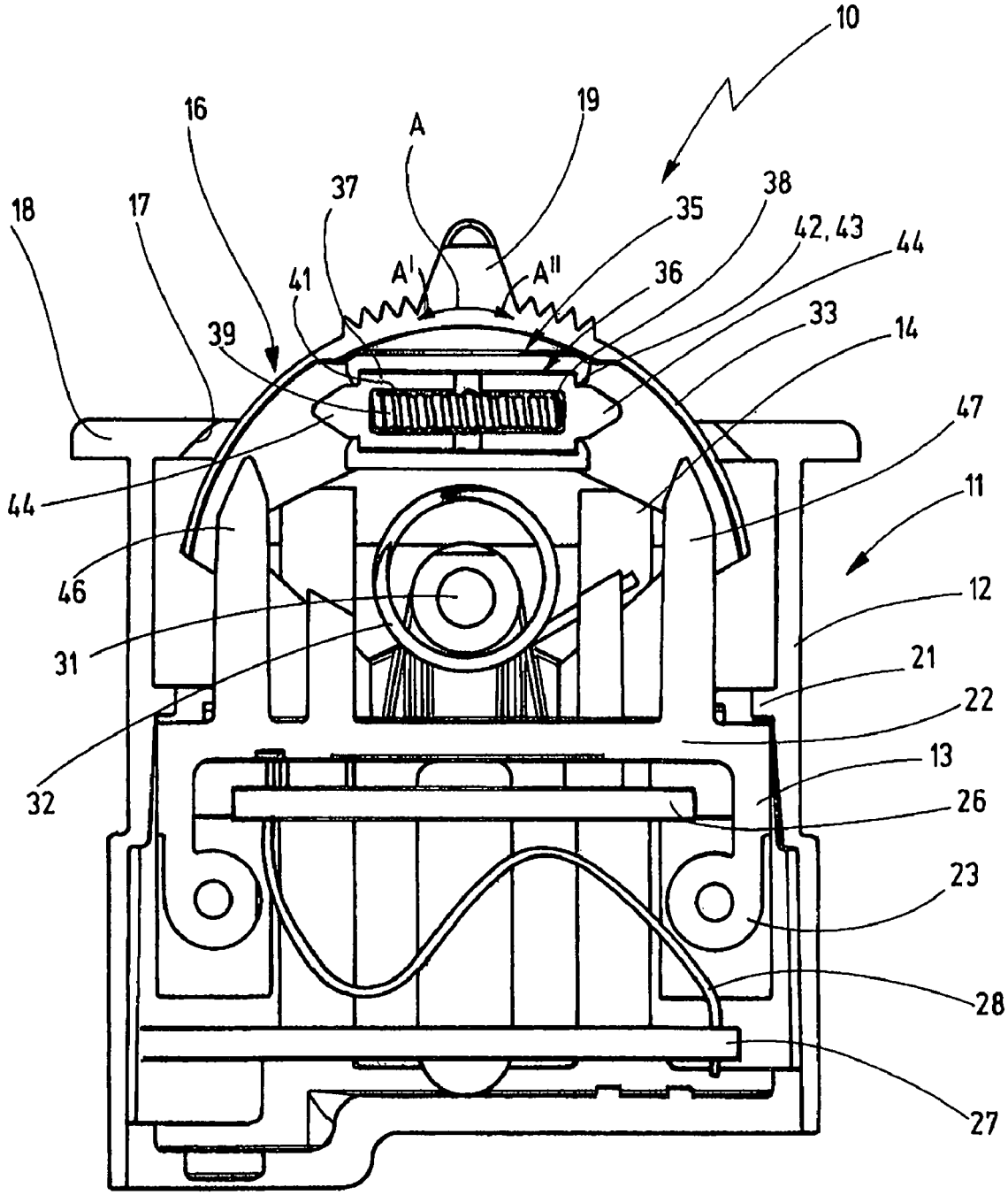
FIG. 1 is a sectional view of an analog rocker switch with overcompression function, in the neutral position.

A rocker 16 (FIG. 3) has a swivel shaft 31 that carries permanent magnets M that operate Hall-effect sensors S to close electrical circuits; in a known manner (e.g. U.S. Pat. No. 6,642,459). The rocker has a lug 19 that is pivoted to the left or right (arrows A' and A") to pivot the rocker. The rocker carries ram ends 44 (FIG. 1) that abut overcompression stops 46, 47 at the end of rocker pivoting. However, even after a ram end 44 abuts a stop such as 46, the rocker can pivot slightly further by the ram 44 compressing a compression spring 39, until a limit stop 48 (FIG. 3) on the rocker abuts a stop 51 on a switch housing 11.

FIG. 1 shows an analog rocker switch 10, which is provided with an overcompression function between its neutral position or initial position (FIG. 1) and its end position(s) in accordance with one or two directions of motion. The rocker switch has a mechanical switch unit which is composed of a switch housing 11 made of plastic, which exhibits an outer part 12 and an inner part 13, and also a switching element 14 and an actuating rocker 16 firmly connected thereto, which covers the switching element by way of a cap.

The outer part 12 of the switch housing 11, which is approximately rectangular in cross-section, has at its upper end a cover 18 with a recess 17 through which the actuating rocker 16, which exhibits an actuating lug 19, projects. The lug projects to such to an extent that an actuation of the actuating rocker 16 in one of two directions according to the double-headed arrow A in each given case is possible as far as the respective limit stop or over the respective maximum actuating-angle displacement. Within a certain height range, the outer part 12 has an inner ring 21, against which an intermediate bottom 22 of the inner part 13 bears. At its lower end 23 the inner part 13 which has been inserted from the underside of the outer part 12 is firmly connected to the outer part 12 in a manner which is not represented in any detail. A printed circuit board 26 is arranged within the lower part of the inner part 13, and a further printed circuit board 27 is arranged below the lower end 23 of the inner part 13, within the outer part 12, the two printed circuit boards, which are equipped with electrical and electronic components, being electrically connected to one another via a cable 28.

The unit consisting of the switching element 14 and the actuating rocker 16 is retained on the inner part 13 of the switch housing 11 by means of a swivel shaft 31 so as to be capable of swivelling in the directions according to the double-headed arrow A. The swivel shaft 31 is surrounded by a spiral spring 32 which brings about a reset into the neutral position or initial position represented in FIG. 1 from each displacement of the actuating rocker 16 after the release thereof.

On the inside of an approximately semicylindrical casing 33, which is provided with the actuating lug 19 on the upper side, of the actuating rocker 16 a cage 35 which includes an overcompression function element 36 is fastened to the switching element 14.

The overcompression function element 36 has two rams 37 and 38, directed diametrically against each other, between which a compression spring 39 is arranged. The compression spring 39 is located in a blind bore 41 pertaining to each of the rams 37, 38, each of the blind bores 41 being less deep than half the length of the optionally biased compression spring 39. The two rams 37 and 38 are pressed, in a manner biased by the compression spring 39, by an outer-ring edge 42 facing away from the blind bore 41 against a stop ring 43 in the cage 35, whereby a conically tapered ram end 44 of the two rams 37 and 38 projects beyond the stop ring 43 constituting the edge of the cage. In the neutral position or initial position both of the actuating rocker 16 or, to be more exact, the switching element 14 and of the two rams 37 and 38 moving in opposite senses in the directions of the double-headed arrow A there is a certain spacing between the two inner ends of the rams 37 and 38. If the overcompression is to act in one direction only, a single spring-loaded ram is sufficient.

Figure 2:
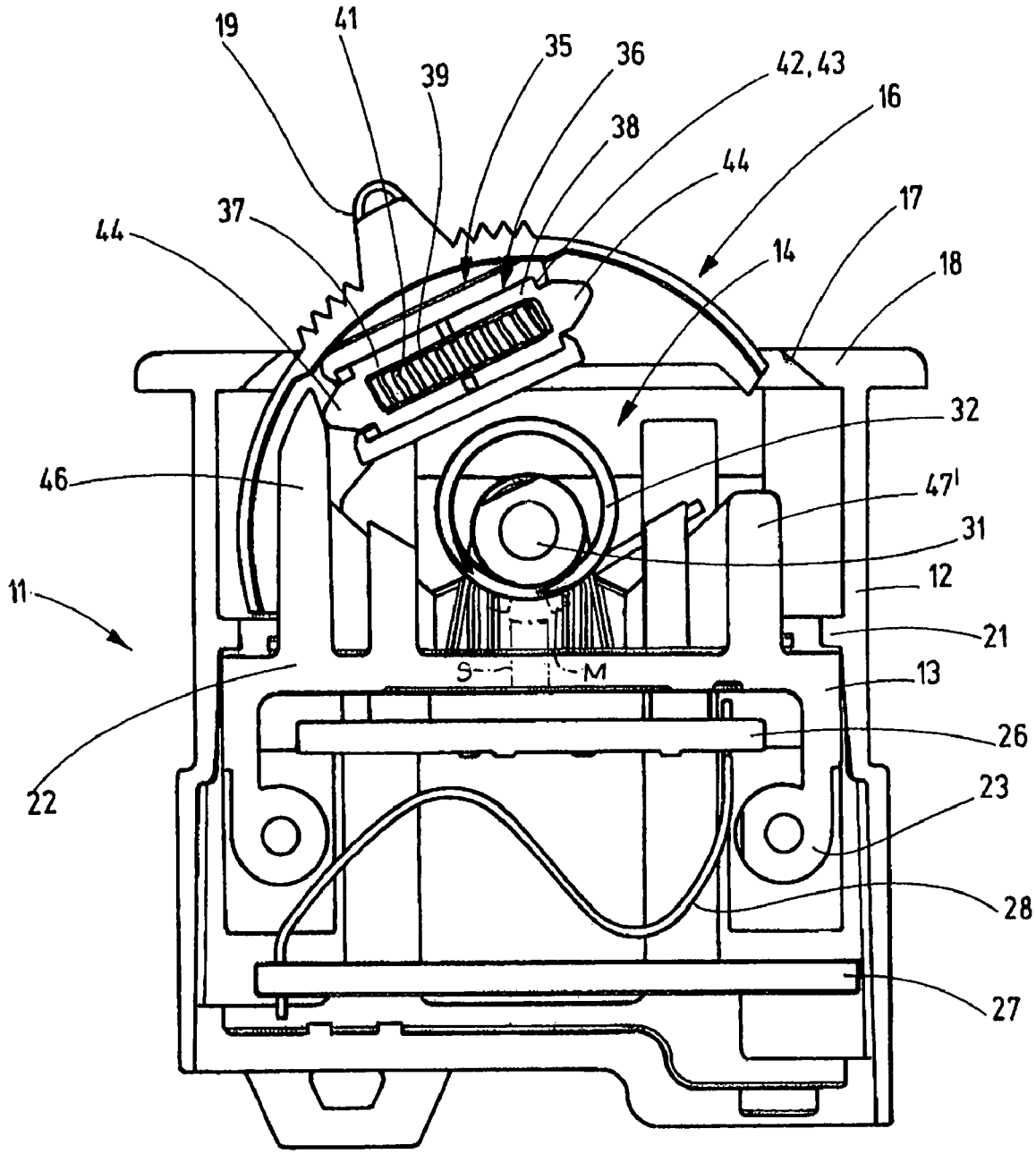
FIG. 2 is a sectional view similar to FIG. 1, but in an end position after the overcompression position, and showing a modified stop element.

According to FIG. 1, the inner part 13 of the switch housing 11 is provided with overcompression stops, or domes 46 and 47 projecting perpendicularly—that is to say, parallel to the outer walls of the inner part 13 and also of the outer part 12—from its intermediate bottom 22, which are configured in such a manner that they project into the preferentially circular path, according to the double-headed arrow A, of the ram ends 44 of the overcompression function element 36 of the switching element 14 or, to be more exact, of the actuating rocker 16. The two overcompression stops 46 and 47 may be equal in length, corresponding to FIG. 1, so that the actuating angle between the neutral position or initial position of the actuating rocker 16 on the one or other overcompression stop 46, 47 is the same. But it is also possible, as represented in FIG. 2, to configure the overcompression stop 47' to be, for example, less high than the overcompression stop 46. This means that the actuating angle from the neutral position or initial position of the actuating rocker 16 as far as the overcompression function in the one direction A' is smaller than in the other direction A". It is also possible to arrange an overcompression stop 46 or 47 in the path of motion of the overcompression function element 36 in only one of the two directions according to the double-headed arrow A.

Figure 3:
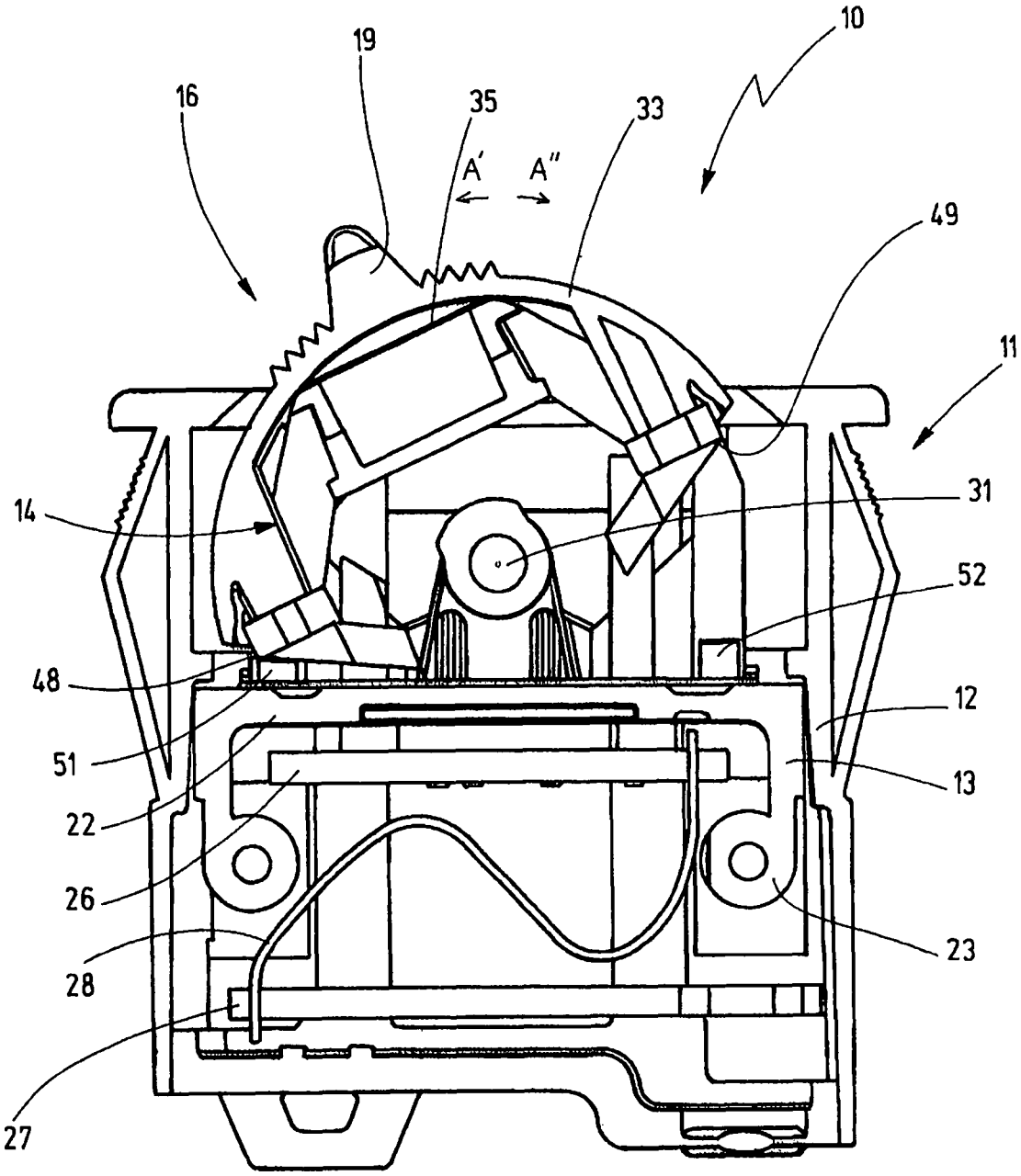
FIG. 3 is another sectional view similar to FIG. 1, in the end position according to FIG. 2.

In FIG. 3 the maximum actuating angle in the direction of arrow A' is represented in a longitudinal section parallel to FIG. 2. It follows from this that the one lower free edge 48 of the switching element 14 directly forms a stop end which bears against a stop dome 51 which likewise projects perpendicularly upwards from the intermediate bottom 22, parallel to the overcompression dome 46. It is self-evident that in the other direction of motion A" a lower free edge 49 of the switching element 14 comes to abut a stop 52 of corresponding arrangement. The two stops 51 and 52 may have the same length, but, as represented in FIG. 3, they may also have differing lengths, for example in such a manner that stop dome 51 is shorter than stop 52. This means that the actuating angle of the actuating rocker 16 as far as the limit stop in the one direction A' is larger than in the other direction A".

The overcompression function of the overcompression function element 36 described above is the following. If the actuating rocker 16 (FIG. 2) with the switching element 14 moves out of the neutral position or initial position represented in FIG. 1 in direction A', the ram end 44 of the one ram 37 comes to abut—after, for example, an actuating angle from 10° to 15°—the overcompression dome 46 in question. If the actuating rocker 16 moves further in direction A', by reason of the compression spring 39 which then comes into action a greater force, having to overcome the spring pressure, has to be expended for the purpose of further motion in direction A'. This higher expenditure of force is necessary until the limit stop 51 according to FIG. 3 is reached. In this position the compression spring 39 is wholly or partly compressed, in which connection an axial spacing between the inner ends of the two rams 37 and 38 is still present. This spacing is smallest when the actuating angle between the overcompression stop 46 and the limit stop 51 is largest. It is self-evident that the mode of operation that has been described obtains correspondingly in the case of actuation in direction A"; according to the arrangement of FIG. 2, the actuating angle between the neutral position or initial position and the attaining of the overcompression stop 47 is larger in that case, so that when the limit stop 52 (FIG. 3) is reached the compression spring 39 is less compressed.

In order to enable the variable actuating angles, described above, between the neutral position or initial position and the attaining of the overcompression stop 46, 47, on the one hand, and between the overcompression stops 46, 47 and the limit stop 51, 52, on the other hand, in straightforward manner in terms of construction and production technology, the inner part 13 of the switch housing 11, which is provided with the stops 46 and 47 as well as 51 and 52, is shaped in accordance with the desired stop lengths in the course of production by means of injection molding. This is obtained by the molding tool or injection-molding tool for producing the inner part 13 of the switch housing 11 being capable of being provided with removable cores which, on the one hand, take account of the differing lengths of the overcompression stops 46 and 47 and/or, on the other hand, the differing lengths of the stops 51 and 52. In corresponding manner the inner part 13 which is provided for the type of rocker switch 10 is introduced into the outer part 12 of the switch housing 11.

In the rocker switch 10 which has been described, the electrical switching of a component, which is provided in accordance with the direction of motion A' or A" of the actuating rocker 16, is effected, for example, by the swivel shaft 31 being provided with permanent magnets spaced over its periphery, whereas, for example, the printed circuit board 26 is equipped with Hall-effect sensors which react to the angular position of the permanent magnet or permanent magnets.

What is claimed is:

1. A rocker switch comprising a plastic switch housing, a switching element supported in spring-loaded manner on said switch housing so as to be capable of moving in back and forth directions on said switch housing, an actuating rocker coupled to the switching element to move it, limit stop elements mounted on said switch housing and positioned to limit the actuating angle of the actuating, an electrical switch unit positioned to be switched by movement of the switching element, and overcompensating stops on the switch housing, characterized in that:

the actuating rocker has an overcompression element that abuts one of said overcompression stops on the switch housing before the rocker abuts the limit-stop elements; and a housing cage for the overcompression element is arranged within the actuating rocker, wherein the housing cage for the overcompression element is arranged between the underside of a preferentially approximately semicylindrical casing and the swivel shaft of the actuating rocker in the switching element.

2. A rocker switch according to claim 1, further characterized in that the overcompression element is constituted by a spring-loaded ram or by two rams which are spring-loaded in opposite senses.

3. A rocker switch according to claim 2, further characterized in that a compression spring is arranged between the two opposite-sense rams.

4. A rocker switch according to claim 2, further characterized in that the ram or rams and the compression spring are retained in a housing cage.

5. A rocker switch according to claim 1, further characterized in that the overcompression stop is molded on the switch housing.

6. A rocker switch according to claim 5, further characterized in that the overcompression stop is constituted by a dome projecting into the preferentially approximately circular path of motion of the ram.

7. A rocker switch according to claim 6, further characterized in that the overcompression stop is molded on an inner part of the switch housing in a perpendicularly projecting manner and has a variable length.

8. A rocker switch according to claim 7, further characterized in that the variable length, of the overcompression stop is capable of being produced by means of removable cores of differing height in a molding tool for the inner part of the switch housing.

9. A rocker switch according to claim 1, further characterized in that the limit-stop elements are constituted by lower edges molded on the switching element and by stop domes, wherein the stop domes are molded on and project perpendicularly from the inner part of the switch housing, and have a variable length.

10. A rocker switch according to claim 9, further characterized in that the variable length of the stop domes is capable of being produced by means of removable cores of differing height in a molding tool for the inner part of the switch housing.

11. A rocker switch according to claim 9, further characterized in that the domes of the overcompression element and the limit-stop elements are equal in length.

12. A rocker switch comprising a plastic switch housing, a switching element supported in spring-loaded manner on said switch housing so as to be capable of moving in back and forth directions on said switch housing, an actuating rocker coupled to the switching element to move it, limit stop elements mounted on said switch housing and positioned to limit the actuating angle of the actuating, an electrical switch unit positioned to be switched by movement of the switching element, and overcompensating stops on the switch housing, characterized in that:

the actuating rocker has an overcompression element that abuts one of said overcompression stops on the switch housing before the rocker abuts the limit-stop elements;

the overcompression element is constituted by a spring-loaded ram or by two rams which are spring-loaded in opposite senses; and a compression spring is arranged between the two opposite-sense rams, wherein the compression spring and the two opposite sense rams are retained in a housing cage.

13. A rocker switch according to claim 12, further characterized in that the overcompression stop is molded on the switch housing.

14. A rocker switch according to claim 13, further characterized in that the overcompression stop is constituted by a dome projecting into the preferentially approximately circular path of motion of the ram.

15. A rocker switch according to claim 14, further characterized in that the overcompression dome is molded on an inner part of the switch housing in a perpendicularly projecting manner and has a variable length.

16. A rocker switch according to claim 15, further characterized in that the variable length of the overcompression stop is capable of being produced by means of removable cores of differing height in a molding tool for the inner part of the switch housing.

17. A rocker switch according to claim 12, further characterized in that the limit-stop elements are constituted by lower edges molded on the switching element and by stop domes, wherein the stop domes are molded on project perpendicularly from the inner part of the switch housing and have a variable length.

18. A rocker switch according to claim 17, further characterized in that the variable length of the stop domes is capable of being produced by means of removable cores of differing height in a molding tool for the inner part of the switch housing.

19. A rocker switch according to claim 17, further characterized in that the domes of the overcompression element and the limit-stop elements are equal in length.

* * * * *